US006522834B1

(12) United States Patent
Herrick et al.

(10) Patent No.: US 6,522,834 B1
(45) **Date of Patent: *Feb. 18, 2003**

(54) ON-DEMAND DIRECT ELECTRICAL RESISTANCE HEATING SYSTEM AND METHOD THEREOF FOR HEATING LIQUID

(75) Inventors: James P. Herrick, Brookfield, CT (US); Sudhir Sastry, Dublin, OH (US); Gene F. Clyde, New Milford, CT (US); Elaine R. Wedral, Sherman, CT (US)

(73) Assignee: Nestec S.A., Vevey (CH)

( * ) Notice: Subject to any disclaimer, the term of this patent is extended or adjusted under 35 U.S.C. 154(b) by 0 days.

This patent is subject to a terminal disclaimer.

(21) Appl. No.: 09/763,410

(22) PCT Filed: Aug. 24, 1999

(86) PCT No.: PCT/US99/19347

§ 371 (c)(1),
(2), (4) Date: Feb. 22, 2001

(87) PCT Pub. No.: WO00/11914

PCT Pub. Date: Mar. 2, 2000

Related U.S. Application Data

(63) Continuation-in-part of application No. 09/139,639, filed on Aug. 25, 1998, now Pat. No. 6,130,990.

(51) Int. Cl.[7] ..... H09B 3/60
(52) U.S. Cl. ..... 392/311; 222/251
(58) Field of Search ..... 392/311–315, 319–324; 99/280, 282; 222/251, 412

(56) References Cited

U.S. PATENT DOCUMENTS 2,680,802 A * 6/1954 Bremer ..... 222/129.1

(List continued on next page.)

FOREIGN PATENT DOCUMENTS

| | | |
|---|---|---|
| DE | 24 43 397 | 4/1976 |
| DE | 40 15 704 | 11/1991 |
| EP | 0 328 283 | 8/1989 |
| EP | 0 457 179 | 11/1991 |

(List continued on next page.)

OTHER PUBLICATIONS

The Influence of Electrial Heating on Particles in Food Mixtures, http://sun1.bham.ac.uk/l.j.davies/work/overview (Jun. 25, 1997).

"Forever Fresh", Food Review 1993, 20 (4) 19, 23 (abstract only).

*Primary Examiner*—Teresa Walberg
*Assistant Examiner*—Thor Campbell
(74) *Attorney, Agent, or Firm*—Winston & Strawn

(57) ABSTRACT

A liquid heater includes at least a pair of electrodes each of which having an electrically conducting surface and being spaced apart from each other. The liquid heater also includes a first heating passage defined, at least in part, by the electrically conducting surfaces of the electrodes. Electrical power to the liquid heater is provided by an electrical power supplier configured to draw an alternating electrical current having a frequency less than or substantially equal to 60 Hz and supply an alternating electrical voltage having a frequency substantially equal to or higher than 50 Hz across the electrodes. The electrodes are arranged to make electrical contacts with liquid received into the heating passage. The liquid in the heating passage generates heat when an electric current flows through the liquid and between electrodes.

20 Claims, 12 Drawing Sheets

U.S. PATENT DOCUMENTS

| | | | | | |
|---|---|---|---|---|---|
| 2,748,253 | A | * | 5/1956 | Bremer | 392/315 |
| 3,218,175 | A | | 11/1965 | Siegel et al. | 99/28 |
| 3,796,857 | A | | 3/1974 | Henley et al. | 219/285 |
| 3,867,610 | A | | 2/1975 | Quaintance | 219/286 |
| 3,925,638 | A | | 12/1975 | Scatoloni | 219/295 |
| 3,983,359 | A | | 9/1976 | Walker et al. | 219/284 |
| 4,015,749 | A | | 4/1977 | Arzberger et al. | 222/70 |
| 4,417,132 | A | | 11/1983 | Simpson | 219/291 |
| 4,730,098 | A | | 3/1988 | Cave | 219/291 |
| 5,267,506 | A | | 12/1993 | Cai | 99/280 |
| 5,583,960 | A | | 12/1996 | Reznik | 392/321 |
| 5,607,613 | A | | 3/1997 | Reznik | 219/771 |
| 5,630,360 | A | | 5/1997 | Polny, Jr. | 99/451 |
| 5,652,006 | A | | 7/1997 | Assinder et al. | 426/231 |

FOREIGN PATENT DOCUMENTS

| | | |
|---|---|---|
| EP | 0 690 660 | 1/1996 |
| FR | 2 422 114 | 12/1979 |
| FR | 2 587 449 | 3/1987 |
| GB | 2 301 270 | 11/1996 |
| GB | 2 304 263 | 3/1997 |
| JP | 3-172161 | 7/1991 |
| JP | 6-78692 | 3/1994 |
| JP | 7-39320 | 2/1995 |
| JP | 8-182470 | 7/1996 |
| JP | 2659313 | 9/1997 |
| NL | 92 00 429 | 10/1993 |
| RU | 572947 | 9/1977 |
| RU | 1685377 | 10/1991 |
| RU | 1792634 | 2/1993 |
| WO | WO 96/04804 | 2/1996 |
| WO | WO 98/16477 | 4/1998 |
| WO | WO 99/08482 | 2/1999 |

* cited by examiner

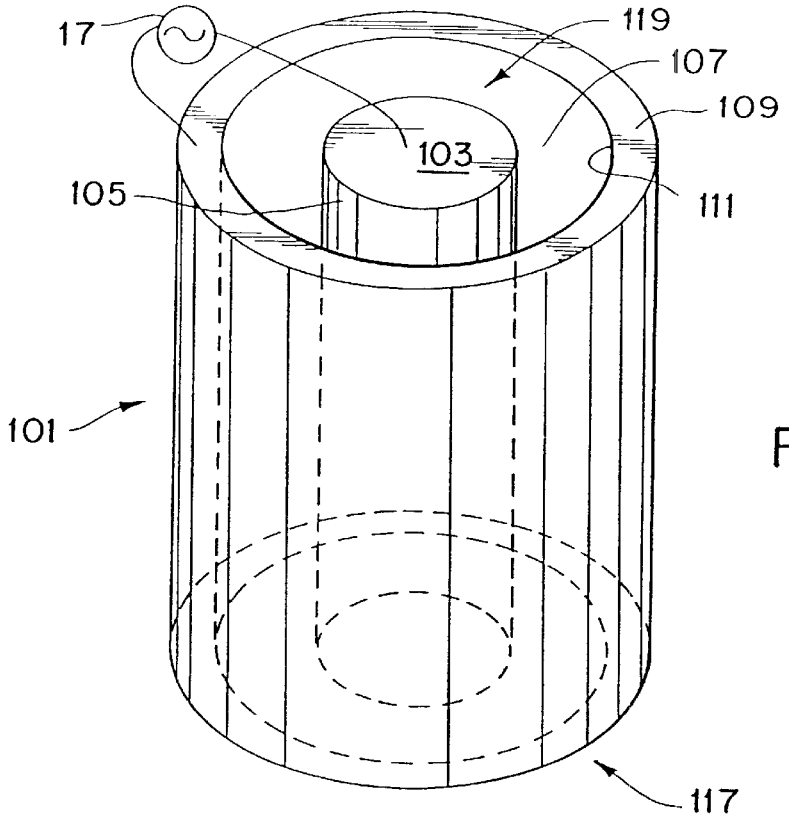
FIG. 2
FIG. 3
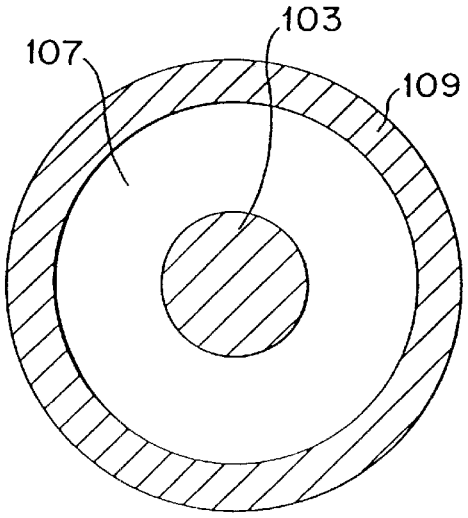
FIG. 4
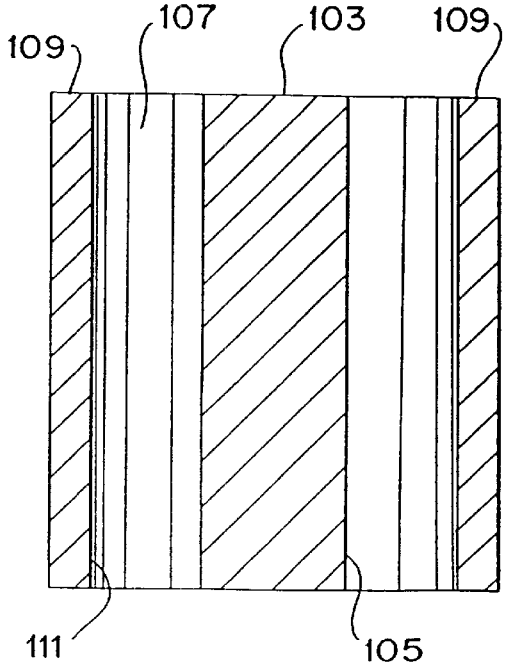

161
195
197
181
183
185
188
163
155
153
165
157
187
186
173
171
179
191
193
169
159
177
175
167
151

207
205
203

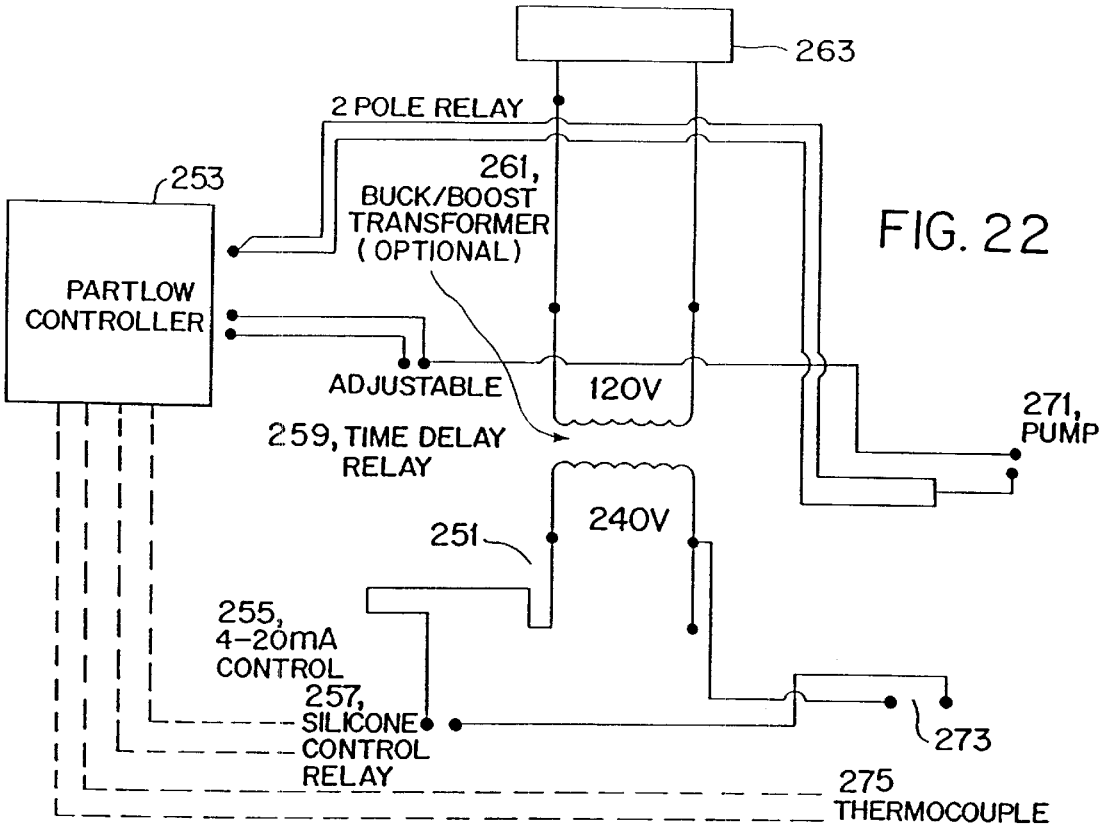
FIG. 22
FIG. 23
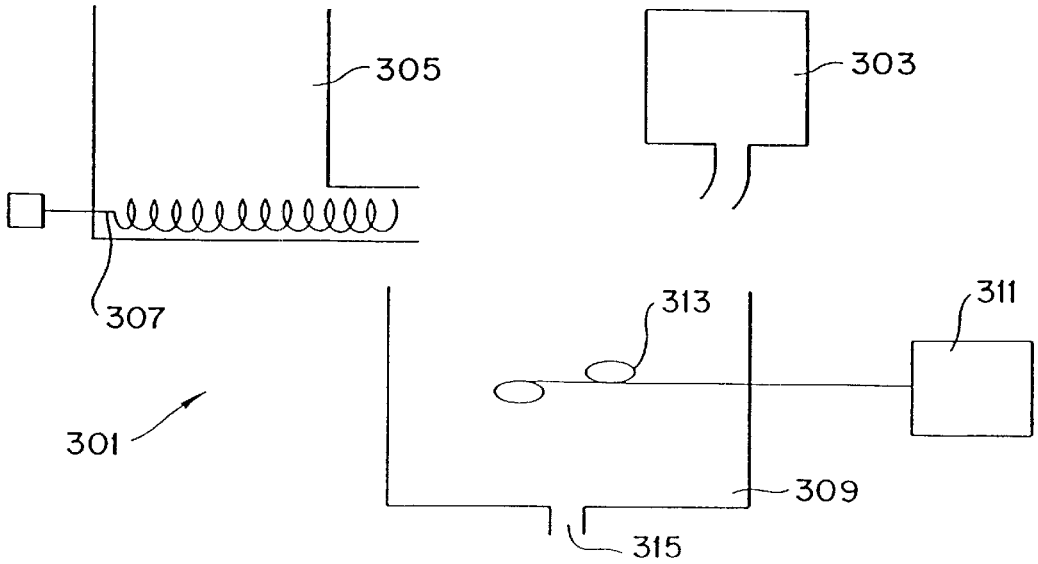

ON-DEMAND DIRECT ELECTRICAL RESISTANCE HEATING SYSTEM AND METHOD THEREOF FOR HEATING LIQUID

CROSS-REFERENCE TO RELATED APPLICATION

The present application is a continuation-in-part of U.S. application Ser. No. 09/139,639, filed Aug. 25, 1998, now U.S. Pat. No. 6,130,990.

FIELD OF THE INVENTION

The present invention relates to liquid heaters for brewing beverage products, for reconstituting dried food products by supplying heated water thereto and for heating liquid food products. More specifically, the present invention relates to liquid heaters utilizing direct electrical resistance (DER) heating devices.

BACKGROUND OF THE INVENTION

Conventional beverage makers such as coffee brewing machines have water storage tanks, commonly made of stainless steel, to hold water and heating rods with which to heat the water in the water storage tanks. The heating rods include tubes packed with sand and heat generating filaments. Heat generated by the filament is transferred to the sand and, then, to the water in the water tank, thereby heating the water.

Other conventional beverage makers include water boilers similar to the hot water storage tanks except that these boilers are held under pressure enabling the water to be heated to a higher temperature.

These conventional beverage makers, however, suffer from a number of drawbacks. For instance, they require a lengthy cold start period during which a cold water tank, or a boiler, filled with unheated water is heated. They also require a long recovery time when heated water is dispensed and, then, replenished with unheated water. In addition, the water quality tends to degrade over time when kept at a high temperature for prolonged periods of time.

In an effort to alleviate the above drawbacks, some of the conventional coffee brewing machines include on-demand water heating devices. These conventional on-demand water heating devices heat water only when requested. Conventional on-demand heating devices that produce small quantities of heated water include indirect electrical resistance heaters which are bonded to a water pipe. On the other hand, conventional on-demand heating devices that produce larger quantities of heated water include heating blocks which contain a coiled water tube and a coiled heating rod encased in a block of metal. The heating block is a thermal energy storage device to heat water on-demand as unheated water passes through the heating block. This requires a constant supply of electrical power to the heating block in order to maintain it at a certain temperature, thereby wasting electrical energy and losing thermal energy to its environment. In general, the conventional on-demand water heaters are inefficient, among other reasons, because they utilize the indirect resistance heating method.

In addition, due to the drawbacks described above, the conventional heating devices cannot produce heated water at a stable temperature which is a desirable feature in brewing some high quality beverages.

Instead of the conventional water heating method described above, direct electrical resistance (DER) heating methods have been developed for industrial uses. The DER method is also known as electroheating, in-line heating or ohmic heating. A conventional DER device includes a pair of electrodes and an electric power supplier for applying a high power to the electrodes. As an electrically conductive medium, such as meat or other food products, passes between the electrodes, electric currents flow through the medium which generate heat therein. The medium generates heat since it acts as a resistor.

Several references disclose the DER methods for heating different types of electrically conductive medium. For instance, U.K. Patent Application No. GB-A-2304263 (the "'263 application") discloses an electroheating, processing, pasteurizing and cooking liquid egg. In this electroheating method, liquid egg is pasteurized when it passes through a pair of electrodes while electric power is applied between the electrodes. This method, however, heats only one type of electrically conductive medium, the liquid egg, in a controlled production line. In addition, this method, as with other conventional DER heating methods, requires a high power electrical power supplier among other industrial strength parts, which tend to be relatively expensive for nonindustrial use.

SUMMARY OF THE INVENTION

Accordingly, a general purpose liquid heater using a DER heating device is provided in the present invention, which does not have the drawbacks of the conventional DER heating devices described above.

First of all, the DER heating device of the present invention draws its electrical power from electrical power outlets commonly supplied to homes, offices, restaurants or food servicing facilities. The DER heating device of the present invention is also adaptable to varying electrical conductivity of different types of liquid. Further, electrodes of the DER heating device of the present invention are made of rigid, relatively insert, electrically conductive material tolerant of wear, e.g., graphite. Other advantages over the conventional water heaters are also described in detail below.

In addition, since the heating device of the present invention utilizes a DER heating device, it is capable of rapid and efficient transfer of the electrical energy into the water as thermal energy while reducing the energy loss associated with the indirect heating methods of the conventional beverage makers discussed above.

More specifically, the liquid heater of the present invention includes a first electrode having an electrically conducting surface and a second electrode having a first electrically conducting surface disposed spaced apart from the electrically conducting surface of the first electrode. The liquid heater also includes a first heating passage defined, at least in part, by the electrically conducting surfaces of the first and the second electrodes, the first heating passage including a first opening configured to receive liquid into the heating passage. Electrical power to the liquid heater is provided by an electrical power supplier configured to draw an alternating electrical current having a frequency lower than or substantially equal to 60 Hz and supply an alternating electrical voltage having a frequency substantially equal to or higher than 50 Hz across the first and second electrodes. In this configuration, the first and second electrodes are arranged to make electrical contacts with liquid received into the heating passage, and the liquid in the heating passage generates heat when an electric current flows between the first and second electrodes and through the liquid. It should also be noted that the alternating electrical voltage to be supplied across the electrodes can have a frequency between 20 KHz and 200 KHz.

Advantageously, the electrical power supplier may include an AC/DC converter configured to convert the alternating electrical current to a direct electrical current, a voltage level controller configured to adjust a voltage level of the converted direct electrical current, and a DC/AC converter configured to generate the alternating electrical voltage to be supplied across the electrodes based on the adjusted voltage level of the converted direct electrical current. The electrical power supplier can further include a transformer coupled to the electrodes and the DC/AC converter, the transformer configured to increase electrical power of the alternating electrical voltage to be supplied across the electrodes. If desired the voltage level controller can further include a pulse width modulated signal generator configured to produce a plurality of pulses each of which having a respective pulse width, a duty cycle switch configured to multiply the plurality of pulses with the direct electrical current from the AC/DC converter, and a filter to generate the adjusted voltage level of the converted direct electrical current. Also, if desired, the second electrode can have a pattern on its electrically conducting surface. The patterns can be a number of arcuate grooves.

In order to control the heated liquid production more efficiently, the liquid heater of the present invention can also include a temperature sensor configured to measure the temperature of the heated liquid, a current meter configured to measure the electrical current flowing between the electrodes and through the liquid, and a controller configured to generate a voltage adjustment signal based on at least one of the measured temperature and the measured electrical current. With this configuration, the voltage level controller is further configured to adjust the voltage level of the converted direct electrical current based on the voltage adjustment signal.

Further, other configurations of the electrodes can be provided. For instance, the first electrode can have a rod shape is disposed within the second electrode that has a cylindrical shape. If desired, additional electrodes that have cylindrical shapes and electrically conducting inner and outer surfaces can also be provided. In this configuration, the second electrode further includes an electrically conducting second surface, and additional heating passages are defined by the electrically conducting second surface of the second electrode and the inner surface of an inner most electrode among the additional electrodes and defined by electrically conducting inner and outer surfaces of the additional electrodes when the additional electrodes are disposed concentrically among each other and from the first and second electrodes.

In yet another configuration of electrodes, the first and second electrodes can have substantially flat surfaces. If desired, additional electrodes with substantially flat surfaces can also be provided. In this configuration, additional heating passages are formed by the additional electrodes when they are disposed in parallel and spaced apart from each other.

In the various electrode configurations described above with multiple heating passages, each heating passage is in liquid communication with adjacent heating passages in order to allow liquid heated in one heating passage to flow to its adjacent heating passage. Further, the electrical power supply is configured to supply electrical voltages to the additional electrodes in an alternating polarization configuration. In addition, the controller can be further configured to adjust the electrical voltage applied to each of the electrodes or to turn on or turn off the alternating electrical voltage applied each of the electrodes.

The present invention also provides beverage product dispensers for use in homes, offices, restaurants and food service facilities using any one of the DER heating devices described above to heat water to make beverage products such as espresso, coffee, hot chocolate, and tea. The beverage product dispenser of the present invention brews the beverage products under desired extraction condition, which may include the temperature of the heated water and the pressure under which the beverage products are brewed, in order to make consistently high quality beverage products. The DER heating device of the present invention can also be utilized in heating liquid food products such sauces and liquid cheese.

The beverage dispenser of the present invention may include a water pipe and a water source connector to supply water to a heating unit. The heating unit includes an inner and outer electrode forming a heating passage. The water supplied to the heating passage generates heat when an electric current flows through the water and between the electrodes. The heating unit is surrounded by an insulating tube and fluid sealed by an inlet sealant and an outlet sealant. The heated water is released to a dispensing head. The dispensing head releases the heated water to a brewing chamber in which the heated water is mixed with grounded beverage substance to produce beverage products.

The beverage dispenser also includes a controller which regulates the amount of water supplied to the heating unit and the amount of electrical current supplied to the electrodes to ensure that the heated water at the dispensing head reaches an optimal water temperature.

In addition, the present invention provides liquid food product dispensers for use in homes, offices, restaurants and food service facilities using DER devices to heat water to reconstitute dried food products or to mix hot water to concentrated food products.

In another embodiment, the present invention also includes a method of heating liquid which includes the steps of supplying unheated liquid into a heating passage formed between a first electrode and a second electrode, passing the liquid through the heating passage, and simultaneously applying an alternating electrical voltage between the first and second electrodes, to thereby generate heat within the liquid supplied to the heating passage when an electrical current flows through the liquid. The method further includes the steps of measuring the electrical current flowing through the liquid, and adjusting the alternating electrical voltage applied to the first and second electrodes based on the measured electrical current, to thereby efficiently control the heating rate of the heated liquid.

If desired the method can further include the steps of converting an alternating electrical current with a frequency lower than or substantially equal to 60 Hz to a direct electrical current, adjusting a voltage level of the converted direct electrical current, and generating the alternating electrical voltage to be supplied across the electrodes based on the adjusted voltage level of the converted direct electrical current. The step of adjusting the voltage level of the converted direct electrical current can also include the steps of generating a plurality of pulses each of which having a respective pulse width, multiplying the plurality of pulses with the direct electrical current, and generating the adjusted voltage level of the converted direct electrical current.

In order to efficiently control the heated liquid production, the method can further include the steps of terminating the electrical voltage applied to the first and second electrodes when the measured amount of the electrical current exceeds a predetermined amount, or calculating conductivity of the liquid supplied to the heating passage based on the measured electrical current. If desired the method can further include the steps of measuring temperature of the heated liquid, and adjusting the amount of the liquid supplied to heating passage based on the measured temperature.

BRIEF DESCRIPTION OF THE DRAWINGS

Preferred features of the present invention are disclosed in the accompanying drawings, wherein similar reference characters denote similar elements throughout the several views, and wherein:

FIG. 2 is a perspective view of a DER heating cell;

FIG. 3 is a top cross-sectional view of the DER heating cell;

FIG. 4 is a side cross-sectional view of the DER heating cell;

FIG. 22 is a circuit diagram of a beverage dispenser controller;

FIG. 23 is a portion of a reconstituted beverage or food product dispenser.

DETAILED DESCRIPTION OF THE INVENTION

Figure 1:
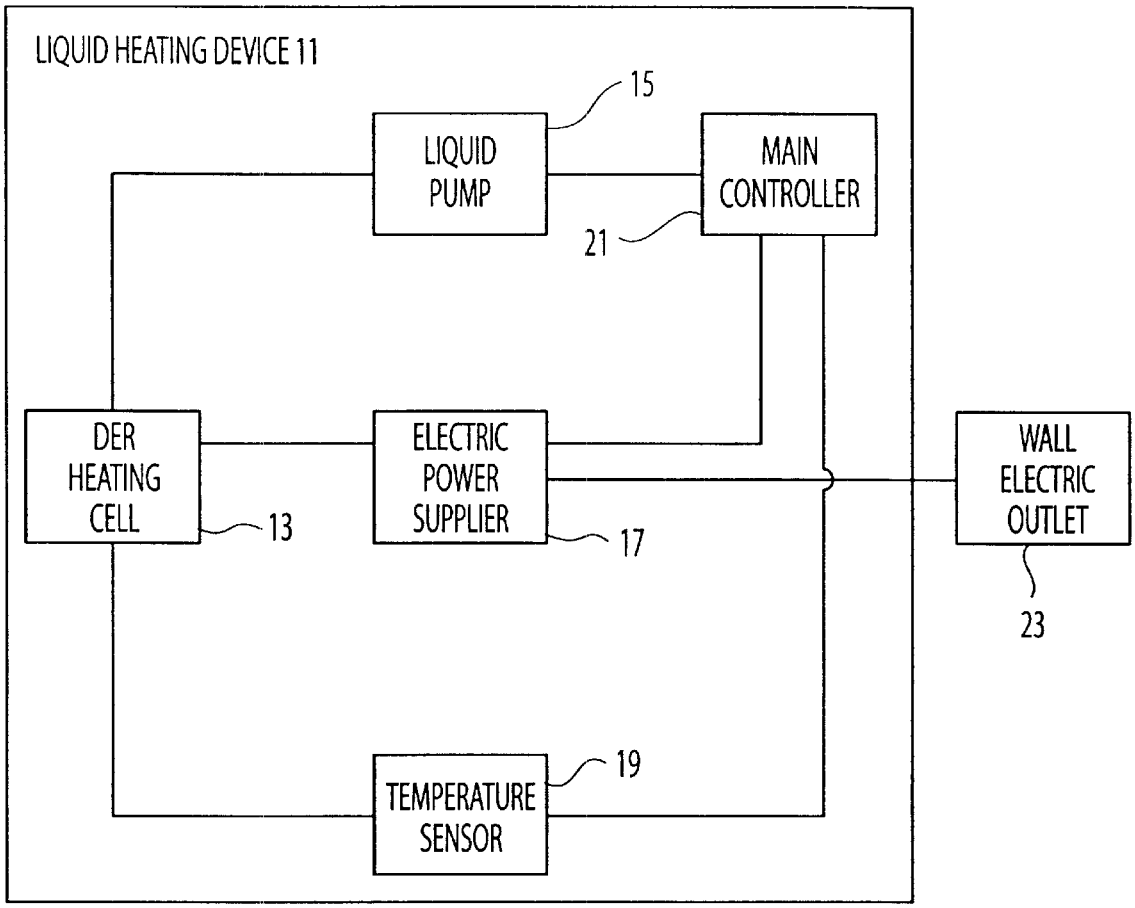
FIG. 1 is a block diagram of a liquid heating device of the present invention.

Referring to FIG. 1 a liquid heating device 11 of the present invention includes a DER heating cell 13 comprising at least a pair of electrodes. The DER heating cell 13 is coupled to a liquid pump 15 configured to supply liquid to be heated to the DER heating cell 13, an electric power supplier 17 configured to supply electrical power across the electrodes in the DER heating cell 13, and a temperature sensor for measuring the temperature of liquid when discharged by the DER heating cell 13. The liquid heating device 11 further includes a main controller 21 coupled to the liquid pump 15, electrical power supplier 17 and temperature sensor 19.

In the embodiment depicted in FIGS. 2–4, a preferred embodiment of the DER heating cell 13 includes an inner electrode 103, an outer electrode 109 and a heating passage 107 defined by a gap between the electrodes 103, 109. Each of the inner and outer electrodes 103, 109 has electrically conducting surfaces 105, 111, respectively. The DER heating cell of this embodiment 101 also has an inlet side 117, which receives the liquid to be heated from the liquid pump 15, and an outlet side 119, which releases the heated liquid. As described above, the electrical power supplier 17 applies electrical power across the electrodes 103, 109.

The inner electrode 103 is preferably a rod, and the outer electrode 109 is a cylinder with which to surround the inner electrode 103. In one alternative embodiment, the inner electrode has a hollow core. Electrodes in any other shape, such as square, rectangular, triangular or oval, are sufficient for the present invention as long as the inner and outer electrodes form a heating passage.

The liquid supplied to the heating passage 107 makes direct physical and electrical contact with the electrodes, thereby allowing an electrical current to flow between the electrodes via the liquid when the electrical voltage is applied by between the electrodes 103, 109 by the electrical power supplier 17.

More specifically, in operation of the DER heating cell 101, a voltage is applied between the inner and outer electrodes 103, 109, and, then, electrical currents flow between the electrodes through the liquid when the liquid is supplied to the heating passage 107. The liquid acts as a resistor by inhibiting the flow of the electrical current, to thereby determine the magnitude of the current flow. This resistance, in turn, causes the liquid to generate heat therein. Hence, as the liquid flows from the inlet side 117 to the outlet side 119 of the heating passage 107, the temperature of the liquid can be raised, e.g., up to 300° F. or any practical limit, in the heating passage 107.

Due to the flow of the electrical currents, the electrodes 103, 109 can be subjected to erosion. The erosion on the electrodes can be proportional to corresponding current density of electric current. In other words, an electrode subjected to higher current density can erode faster than an identical electrode subjected to less current density. Therefore, the inner electrode 103 can be subjected to a higher current density compared to the outer electrode 109 because the inner electrode has a smaller conducting surface than that of the outer electrode. This causes disproportional erosion on the inner electrode 103.

Figure 5:
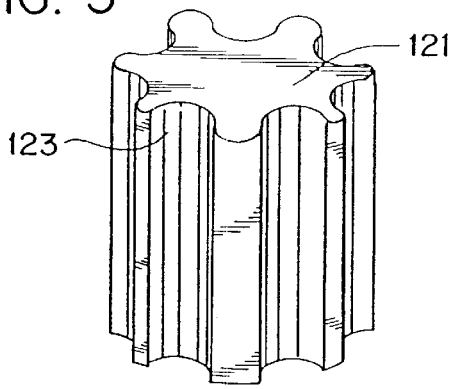
FIG. 5 is a perspective view of an inner electrode with semicircular grooves.
Figure 6:
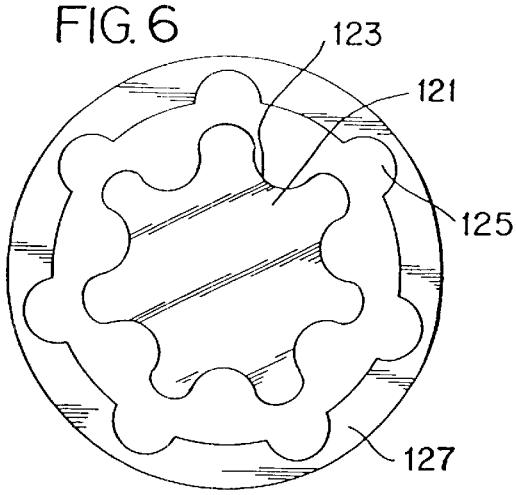
FIG. 6 is a top cross-sectional view of an inner electrode and an outer electrode with semi-curricular grooves.

This phenomenon of disproportional erosion is ameliorated when the surface area of the inner electrode 103 is increased. In one embodiment, depicted in FIG. 5, the surface area of an inner electrode is 121 increased by providing a pattern 123 on its surface. The pattern is preferably a plurality of arcuate grooves 123 that are cut longitudinally into the inner electrode 121. The size and the shape of the grooves are determined to minimize the disproportional erosion on the electrically conductive surfaces of the inner and outer electrodes. However, any pattern, such as rectangular, triangular, oval or semicircular, that increases the surface area of the inner electrode is sufficient for the present invention. In yet another embodiment, an outer electrode 127 also has a pattern that matches the pattern formed into the inner electrode, as illustrated in FIG. 6, in order to increase the surface area of the outer electrode 127.

In addition, referring back to FIG. 2, when the liquid is water, the outlet side 119 of the electrodes can be subjected to a higher rate of erosion compare to that of the inlet side 117. This is caused by changing water conductivity. As the water temperature increases, its conductivity increases allowing more electrical current to flow at the outlet side 119 of the electrodes, thereby subjecting the outlet side of electrodes to a higher current density than that of the inlet side.

Figure 7:
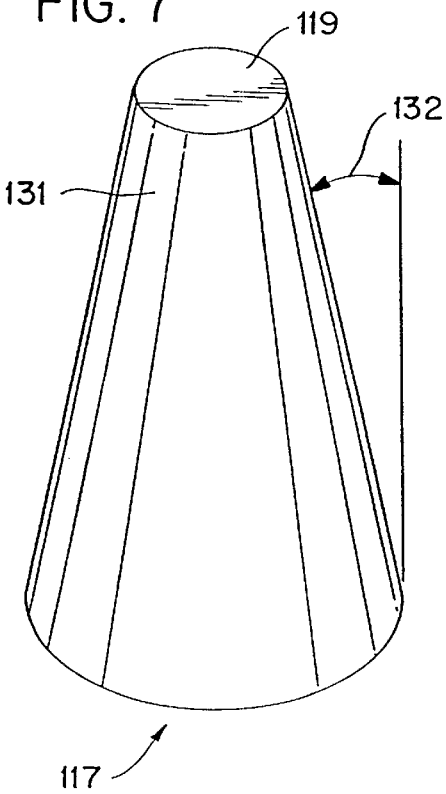
FIG. 7 is a perspective view of a conical inner electrode.

In order to reduce this imbalance of current densities and to evenly heat the liquid, in one preferred embodiment, a conical inner electrode 131 is provided as depicted in FIG. 7. When the conical inner electrode 131 is combined with the cylindrically shaped outer electrode 109, the gap at the inlet side 117 of the electrode is narrower than that of its outlet side 119. In an exemplary embodiment, the angle 132 formed by the thickness difference between the inlet and outlet sides of the inner electrode 131 is on the range of 0.5°–2°; however, steeper angles are also contemplated within this invention.

Hence, at the inlet side, where the water is cold and has lower electric conductivity, the gap between the electrode is narrower than that of the outlet side where the water is heated and has higher electric conductivity. This geometry of electrodes allows for a reduction of the imbalance in the amount of electrical current flowing. In this preferred embodiment, any combination of differently shaped inner and outer electrodes is adequate for the present invention as long as the combination reduces the imbalance in the erosion of the electrodes.

If other liquids having the conductivity and the temperature relationship reverse to that of water are used, then the geometry of the electrodes should be reversed. In other words, if a liquid exhibits lower electrical conductivity as its temperature rises, then a heating unit to heat such a liquid will have a reversed conical inner electrode to balance the current densities at its inlet and outlet side of its electrodes.

Figure 8:
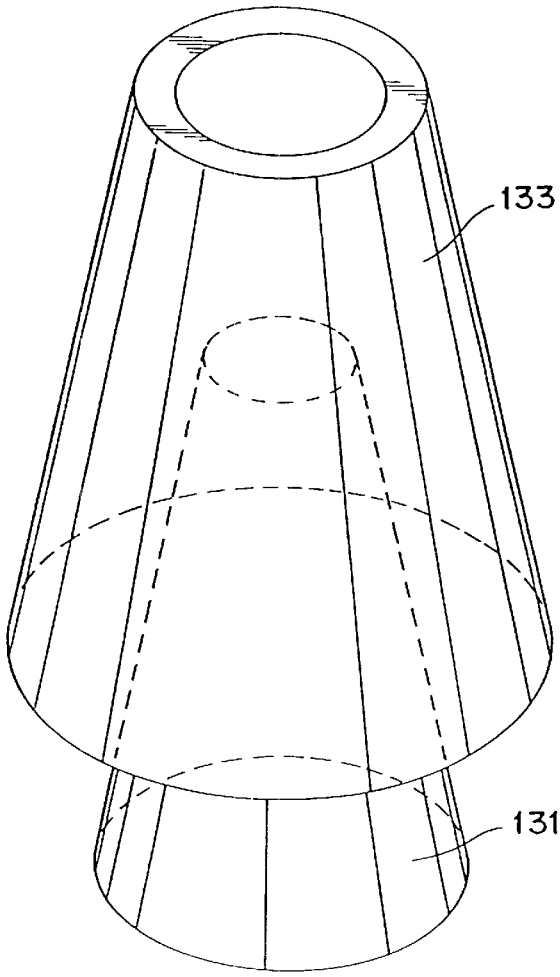
FIG. 8 is a perspective view of a conical inner electrode and a conical outer electrode.

Now referring to FIG. 8, a DER heating cell with an adjustable gap between the electrodes is provided. In this embodiment, a conical inner electrode 131 and a conical outer electrode 133 are provided, and the position of one of the electrodes is adjusted. As one of the electrodes moves close to the other electrode, the gap between the electrodes decreases, and vice versa. In another embodiment, the positions of both electrodes are adjusted.

A shifter is provided to adjust the positions of the electrodes. In one preferred embodiment, the shifter is a threaded rod one end of which is connected to the bottom of inner electrode 131 and the other end of which is protruding from the DER heating cell, thereby allowing an operator to adjust the position of the inner electrode. In other embodiments, a motor controlled by the main controller and connected to the one of the electrodes adjusts the position of the electrodes.

Figure 10:
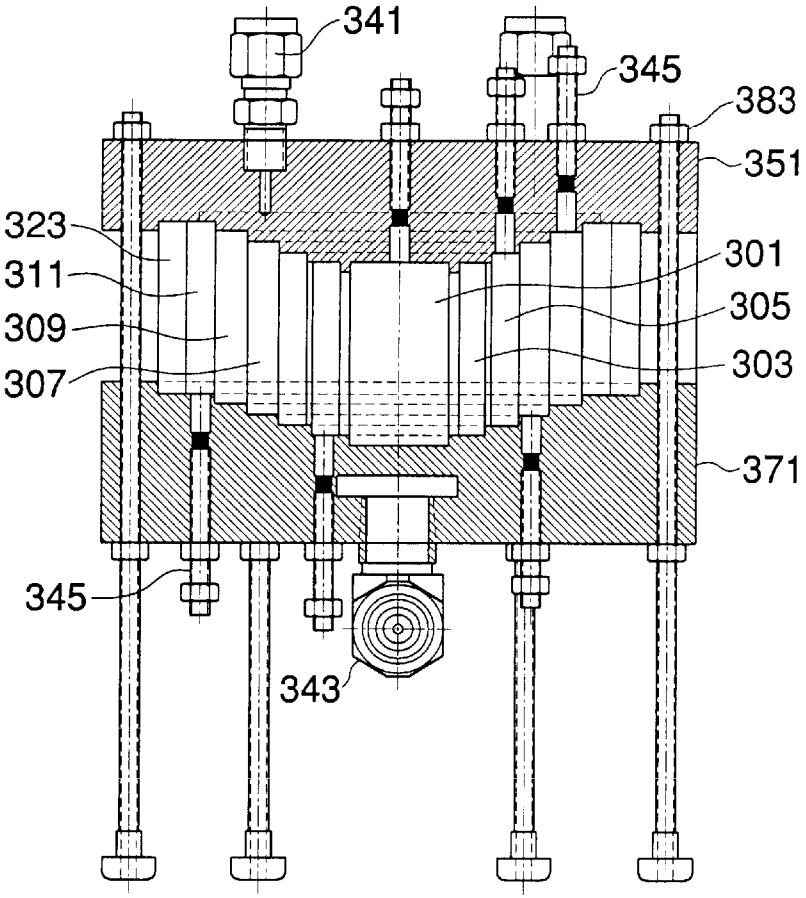
FIG. 10 is a side cross-sectional view of the DER heating cell that utilizes the concentric electrodes.
Figure 9:
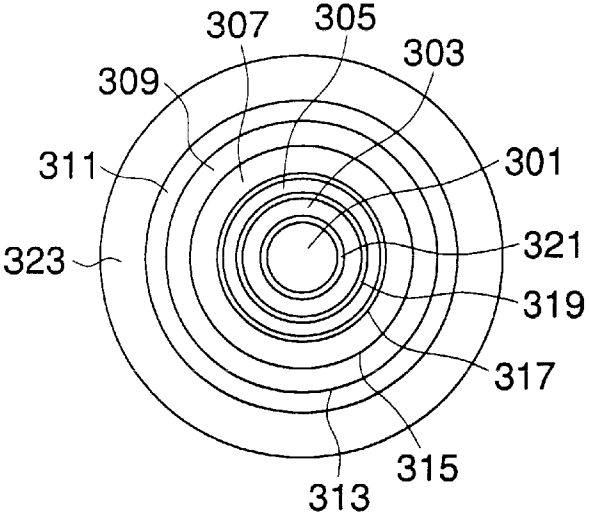
FIG. 9 is a top view of a set of concentric electrodes.

Referring to FIGS. 9–10, in another embodiment, the DER heating cell 13 includes an outer cover ring 323, made from a rigid material with no substantial thermal and electrical conductivity, a central electrode, i.e., electrode F 301 and five concentric cylindrical electrodes having circular cross-section viewed from the top thereof, F-A, 303, 305, 307, 309, 311, respectively. The electrodes are spaced apart from each other in order to form a gap between each pair as illustrated in FIGS. 9–10. In one embodiment, the outer most gap 313, Gap I, has the smallest gap size, the inner most gap 321, Gap V, has the largest size and the intermediately located gaps 315, 317, 319, Gaps II, III, IV, respectively, have the intermediate sizes. The following table illustrates an example set of electrode sizes and corresponding gap sizes.

| | Inside Diameter (inches) | Outside Diameter (inches) | GAP SIZE (inches) |
|---|---|---|---|
| Electrode A | 3.360 | 3.860 | |
| Electrode B | 2.800 | 3.300 | Gap I: 0.030 (between electrodes A and B) |
| Electrode C | 2.240 | 2.740 | Gap II: 0.030 (between electrodes B and C) |
| Electrode D | 1.680 | 2.180 | Gap III: 0.030 (between electrodes C and D) |
| Electrode E | 1.100 | 1.600 | Gap IV: 0.040 (between electrodes D and E) |
| Electrode F | 0.000 | 0.900 | Gap V: 0.100 (between electrodes E and F) |

Each of the gaps includes an inlet side configured to receive liquid to be heated, a heating passage formed by the respective electrodes and an outlet side configured to discharge the liquid. Further, each outlet is in liquid communication with the inlet of an adjacent inner gap. For example, the liquid to be heated is first supplied to the inlet of Gap I 313 by the liquid pump 15. The liquid is then heated while flowing through Gap I 313, and released therefrom via its outlet. The outlet of Gap I 313 is in liquid communication with the inlet of Gap II 315. Therefore, the discharged liquid from Gap I flows to the inlet of Gap II and so on to Gap V where the heated liquid is discharged from the DER heating cell. Therefore, successive electrodes and gaps surround each other so that a liquid passage zigzags between adjacent electrodes in series. Electrodes 305, 307, 309 are each disposed laterally between electrodes 303 and 311 with respect to the longitudinal direction of the liquid flow between an adjacent pair of the electrodes, such as through gaps 313, 315, 317, 319, and 321. It should be noted that the gap sizes specified in the above table is for the purpose of illustration only. Therefore in alternative embodiments, the sizes of the gaps can be either all different from or identical to each other. In other embodiments, the gap sizes may change either proportionally or without being proportional to the above table. In yet other embodiments, the gap sizes may increase from the innermost gap to the outermost gap.

Figure 13:
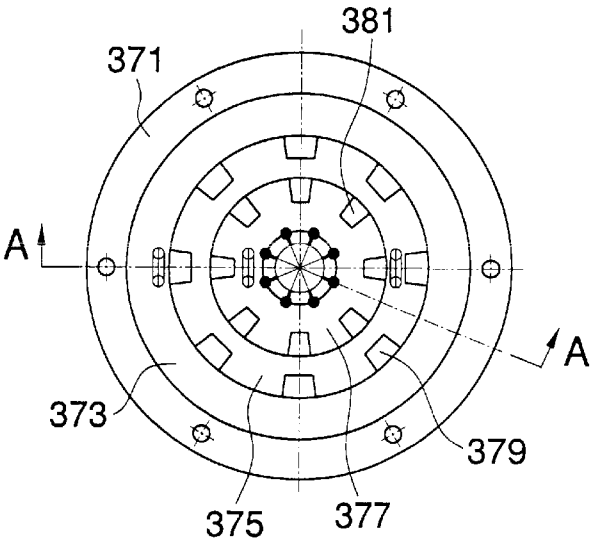
FIG. 13 is a top view of a bottom cap of the DER heating cell that utilizes the concentric electrodes.
Figure 14:
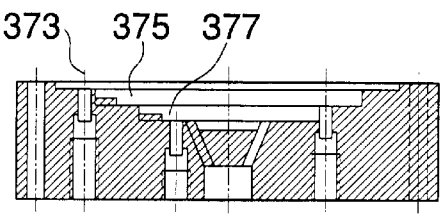
FIG. 14 is a side cross-sectional view of the bottom cap of the DER heating cell that utilizes the concentric electrodes.
Figure 11:
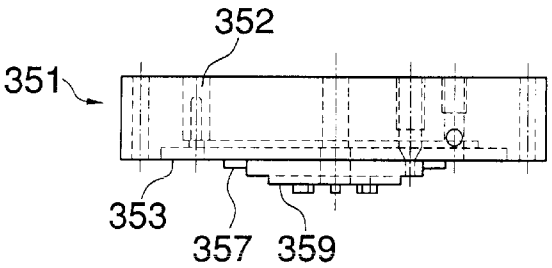
FIG. 11 is a side view of a top cap of a DER heating cell that utilizes the concentric electrodes.
Figure 12:
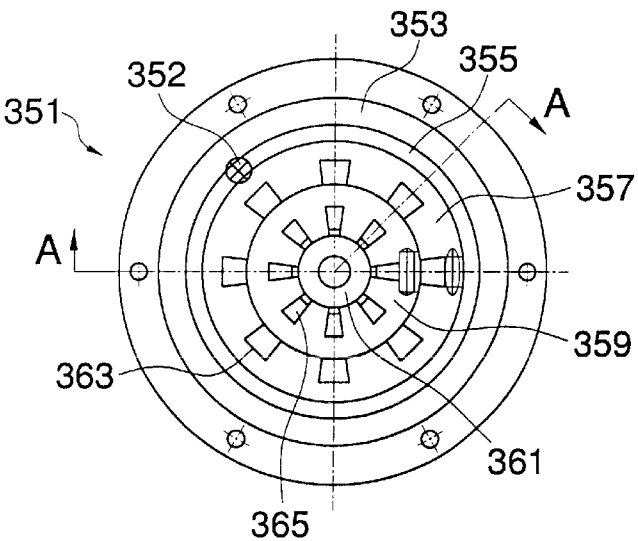
FIG. 12 is a bottom view of the top cap of the DER heating cell that utilizes the concentric electrodes.

The fluid communication between the inlets and outlets of the gaps are achieved by using top 351 and bottom 371 caps. Each of the top and bottom caps has a plurality of concentric annular grooves and/or steps with which to receive portions of the electrodes. In order to achieve liquid tight fluid communication between the gaps, the annular steps formed on the top 351 and bottom 371 caps are provided with a number of channels, e.g., taps or grooves, within the steps. More specifically, the top cap 351, as shown in FIGS. 11–12, includes two annular grooves, i.e., first 353 and second 355 grooves, and at least three protruding annular steps, i.e., first 357, second 359 and third 361 steps. The first 353 and second grooves 355 receive the top sides of the outer cover ring 323 and electrode A 311, respectively. The first protruding step 357 is further divided into two halves, inner and outer halves. The outer half of the first protruding step receives the top side of electrode B 309; the inner half receives the top side of electrode C 307. A number of channels 363 are formed in the inner half of the first step, which allow liquid communication between Gaps II and III. The second protruding step 359 is also divided into two halves, i.e., inner and outer halves. The outer half of the second protruding step receives the top side of electrode D 305; the inner half receives the top side of electrode E 303. A number of channels 365 are also formed in the inner half of the second step, which allow liquid communication between Gaps IV and V. The third step 361 receives the top side of electrode F 301. The bottom cap 371, as illustrated in FIGS. 13 and 14, includes a number of annular grooves, ie., first 373, second 375 and third 377. The first groove 373 receives the bottom sides of the outer cover ring 323 and electrode A 311. The second annular groove 375 is further divided into two halves, inner and outer halves. The outer half of the second groove receives the bottom side of electrode B 309; the inner half receives the bottom side of electrode C 307. A number of channels 379 are formed in the outer half of the second groove, which allow liquid communication between Gaps I and II. The third annular groove 377 is also divided into two halves. The outer half of the third groove receives the bottom side of electrode D 305; the inner half receives the bottom side of electrode E 303. A number of channels 381 are formed in the outer half of the third groove, which allow liquid communication between Gaps III and IV. The channels formed in the top and bottom caps are sufficiently deep and wide so as to allow welling up of the liquids therein in order to provide substantially equal pressure in supplying the welled up liquids to the next gap in the chain of gaps.

The top cap also includes an opening 352 to receive a liquid fitting 341 configured to receive liquid from the liquid pump and discharge the liquid into Gap I. It should be noted that the top cap 351 may include more than one opening to receive more than one liquid fitting. For instance, the top cap may have four opening to receive four liquid fittings in order to equally distribute liquid pressure throughout Gap I. When the top 351 and bottom 371 caps and the electrodes are assembled, and fastened by fasteners 383, e.g., bolts and nuts, as shown in FIG. 10, the liquid received from the liquid fitting 341 flows through Gap I to Gap II via the channels 379 formed in the second groove 375 of the bottom cap 371. The liquid then flows through Gap II to Gap III via the channels 363 formed in the first protruding step 357 of the top cap 351. Subsequently, the liquid flows through Gap III to Gap IV via channels 381 formed in the third groove 377 of the bottom cap 371. Lastly, the liquid flows through Gap IV to Gap V via channels 365 formed in the second step 359 of the top cap 351. The heated liquid, which has been heated while flowing through all five gaps, is discharged from the outlet of Gap V via a discharge liquid fitting 343.

The top and bottom caps further include openings for receiving electrical connection plugs 345 which connects each of the electrodes with the electrical power supplier. Each electrode is supplied with electrical voltage with alternating polarity. For instance, when electrode A is supplied with electrical voltage with one polarity, then electrode B is supplied with the opposite polarity electrical current. Further in this embodiment, the electrical voltage supplied to each of the electrodes can be controlled individually. For instance, the electrical voltage supplied to electrodes A and B can be turned off when they are not needed in increasing the temperature of the liquid to a predetermined range. The actual control of electrical voltages to the individual electrodes will be discussed later.

The above embodiment of including multiple gaps allows the total length of the DER heating cell to be shorter than the embodiment using only one pair of electrodes are provided. This feature makes the size of the DER heating cell 13 to be compact. This is advantageous when space is limited for any appliance that uses the DER heating cell 13 of the present invention. It should be noted that any arbitrary number of electrodes and gaps can be provided.

It should also be noted that the above described top and bottom caps can be exchanged. In other words, in an alternative embodiment, the top cap may include grooves only and the bottom cap may include protruding steps. Further, the number of channels can be one (1) to any arbitrary number as long as the discharged liquid from one gap can be supplied to the next gap. In yet another embodiment, the top and bottom caps are designed such that the liquid may flow from the innermost gap to the outermost gap.

The top and bottom caps are molded substantially from ULTEM™ polyetherimide of GE Plastics. In alternative embodiments, ERTALYTE® PET-P, a semi-crystalline thermoplastic polyester based on polyethylene terephthalate manufactured from resin grades made by DSM Engineering Plastic Products, or PEEK™ polymer, is utilized. However, any rigid, moldable and dielectric material thermally non-conductive and graded for food processing is adequate for the present invention.

Figure 15:
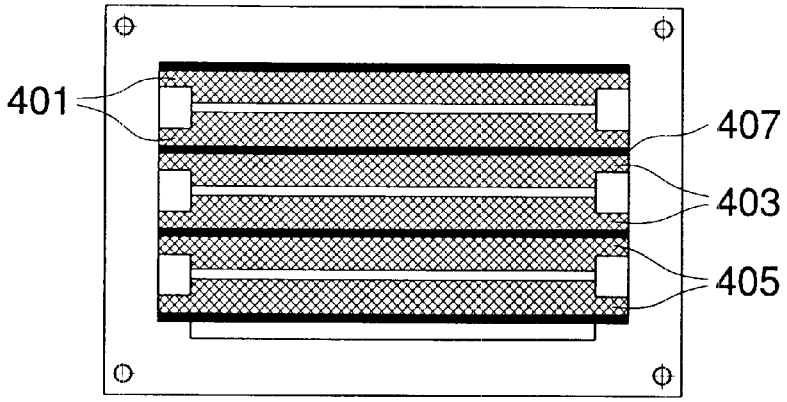
FIG. 15 is a top cross-sectional view of a set of parallel shaped electrodes.
Figure 16:
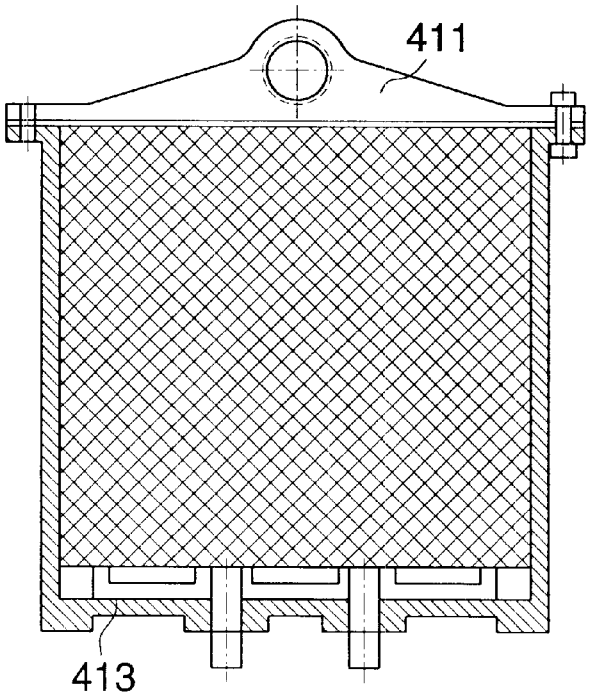
FIG. 16 is a side view of a DER heating cell that utilizes the parallel shaped electrodes.

In another preferred embodiment, depicted in FIGS. 15–16, the DER heating cell 13 may include a number of plate shaped electrodes disposed in parallel. More specifically, three pairs of plate shaped electrodes are provided. The first pair 401 forms a small gap, e.g., 1/100 inch, the second pair 403 forms a larger gap, e.g., 3/100 inch, and the third pair 405 forms even a larger gap, e.g., 8/100 inch. An electrical insulator 407 is placed between the electrode pairs. The gap formed by the first pair receives liquid to be heated from the pump and the heated liquid flows from the first gap to the second gap and then to the third gap via a number of channels formed in a top 411 and bottom 413 pieces. In other words, the top piece includes a first set of channels connecting an outlet side of the first gap to the inlet side of the second gap. The bottom piece includes a second set of channels connecting an outlet side of the second gap to the inlet side of the third gap. Therefore, a liquid passage zigzags between adjacent ones of the plate electrodes, which are planar in the preferred embodiment. Even though the embodiment illustrated in FIG. 15 shows only three pairs of electrodes, an arbitrary number of pairs of electrodes can be provided in alternative embodiments.

The top 411 and bottom 413 pieces are also configured to receive electrical connection that connects each of the electrodes to the electrical power supplier. As in the case with the concentric electrodes described above, the electrical power supplied to each pair of the electrodes can be individually controlled, thereby allowing efficient control of the electrodes. Another added benefit of the plate shaped electrodes is that they are simpler to manufacture compared with the cylindrical electrodes.

The electrodes described in the above embodiments are preferably made substantially of graphite or a combination of carbon and graphite; however, any inert, rigid, electrically conductive material tolerant of wear and graded for food processing can be made into the electrodes of the present invention. In an alternative embodiment, any suitable material, even non-conductive material can be either coated or plated with a conductive material, suitable for the application, and utilized to form the electrodes. For instance, in an exemplary embodiment, a ceramic material plated with inert, electrically conducting and precious metal, such as platinum, can be utilized to form the electrodes. In other embodiments, the electrodes may form only part of the heating passages. In other words, parts of the heating passage can be formed by non-electrically conducting material while other parts of the heating passage can be formed by electrically conducting material.

When the liquid is water, for example, the DER heating cell 13 in the above embodiments is capable of receiving water at 70° F. or colder and heating it, preferably, up to 200° F. and, alternatively, up to 300° F. In one preferred embodiment, the water temperature is raised to be between 187° F.–196° F. In addition, a DER heating cell capable of water flow rate up to 2 or 3 gallons per minute is contemplated within this invention. As illustrated with the above described embodiments, the gap size and the length of the heating passage vary with the required water flow rate along with other factors such as the conductivity of the water and the temperature difference between the heated and unheated water.

In one preferred embodiment, requiring a low water flow rate, 150–250 ml per minute, the gap between the inner and outer electrodes 103, 109 of FIGS. 2–4 is on the range of 0.010–0.500 inches for a heating passage having a length between 2–6 inches. In another embodiment, requiring a water flow rate between 160–200 ml per minute, the gap between the inner and outer electrode 103, 109 is on the range of 0.010–0.118 inches for a heating passage having a length between 2.5–3.5 inches. In yet another embodiment, requiring a higher flow rate, 2–4 gallons per minute, the gap between the electrodes is on the range of 0.25–0.35 inches for the heating passage having a length between 10–14 inches. In other words, the liquid heating device of the present invention is capable of producing 0.15–15 liters per minute depending on the size and configuration of the gap. It should be noted that the gaps in the concentric electrodes, FIGS. 9–10, and the parallel electrodes, FIGS. 15–16, can also be adjusted as described above. The preceding embodiments, especially embodiments with narrow gaps, allow the unheated water to be heated with a minimal initial waiting period and to a consistent temperature. The initial waiting period is reduced since the water volume in the narrow gap is small. Further, the heating of liquids during the initial waiting period can be effectively controlled by a delay mechanism described below. The consistent temperature of the heated water is possible since, again, the volume within the heating passage is small, the water temperature may readily be monitored and controlled. It should be noted that other types of liquid can also be heated to the temperature ranges and flow rates similar to the above description.

Figure 17:
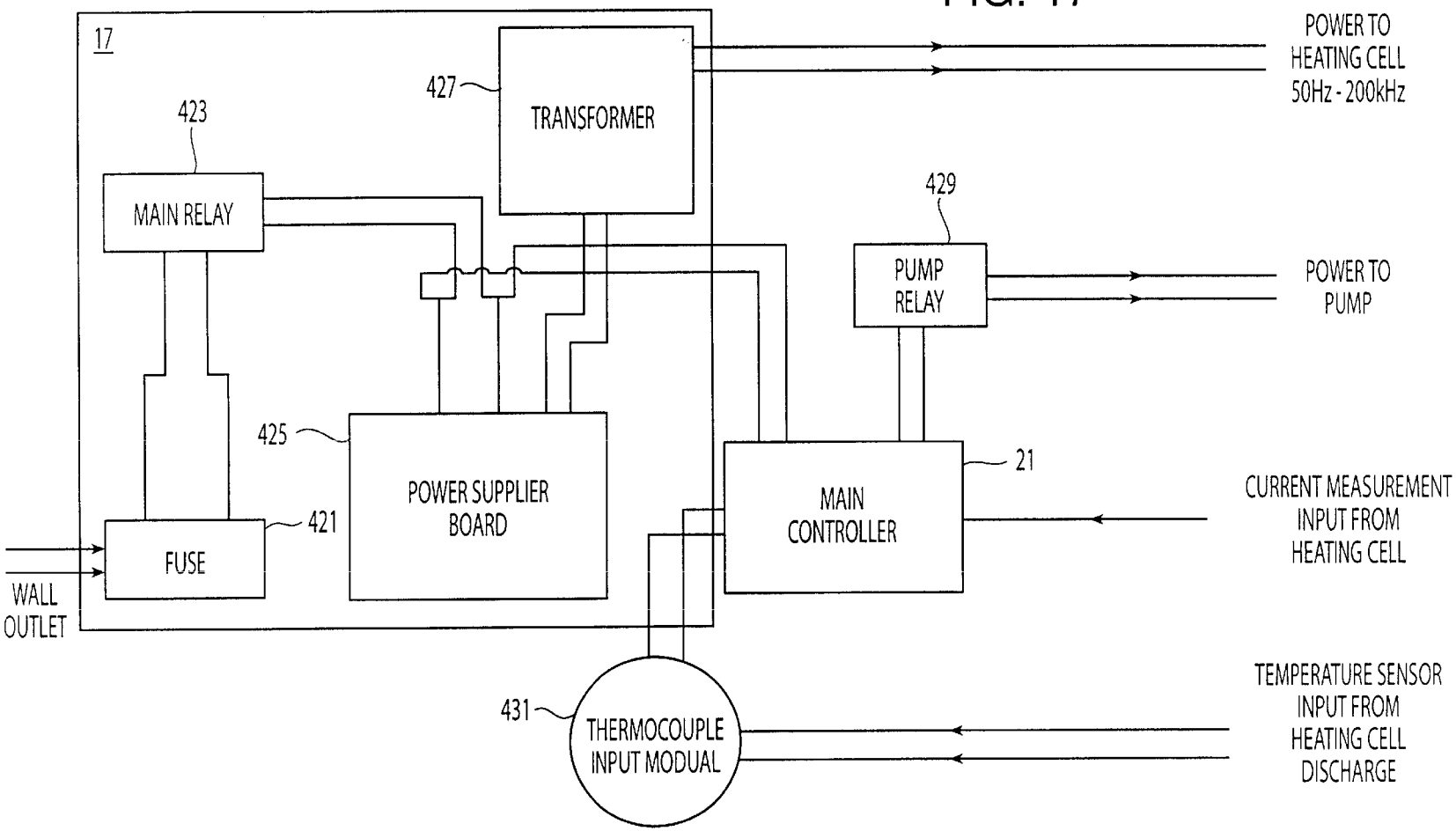
FIG. 17 is a detailed block diagram of electrical components of the liquid heating device.

Referring back to FIG. 1, the power supplier 17 receives its electric power from a wall outlet 23, commonly furnished in homes, offices, stores and restaurants, which provides 120 V–480 V alternating electric power with its frequency between 50–60 Hz and with 10–75 Amp. Referring to FIG. 17, the power supplier 17 includes a fuse 421 and a main relay circuits 423 for receiving and supplying the AC current from the wall outlet to a power supplier board 425.

The rate in which the liquid heats up in the DER heating cell 13 is proportional to the electrical power supplied thereto. The more electrical power supplied to the DER heating cell 13, the faster the liquid heats up. Electrical power is proportional to a product between the electrical current's instantaneous voltage and instantaneous current. Conventional industrial DER systems employ a switch so as to control the power by varying the percentage of the time, the voltage and the current that are applied to their electrodes. These configurations however cause a flickering effect on other electrical appliances connected to the same electrical power source. This flickering effect occurs because, as the conventional DER system draws more electrical power, less electrical power is supplied to other electrical appliance, e.g., electrical lamps. The repeated turning on and off of the transformer causes the flickering in the other electrical appliances.

The power supplier in the present invention is configured to minimize the flickering effect, draw a uniform electrical voltage and control the level of the electrical voltage supplied to the DER heating cell 13. In one preferred embodiment, as shown in FIG. 18, the power supplier board 425 includes an AC/DC converter 451, a voltage level controller 452, a DC/AC converter 459.

The AC/DC converter 451 includes a rectifier and a large capacitor. In this configuration, the alternating current from the wall outlet 23 is rectified by the rectifier and then smoothed out by the larger capacitor in order to generate a substantially uniform direct current. For instance, the alternating current from the wall outlet can be 120V rms (root mean square), and the voltage output level of the AC/DC converter 451 can be 150–160V.

The voltage level controller 452 adjusts the voltage level of the direct current generated by the AC/DC converter 451. The voltage level is proportional to the requirement of the DER heating cell 13. More specifically, as more electrical power is required, the voltage level controller 452 adjusts its output voltage to be high, and vice versa.

Figure 18:
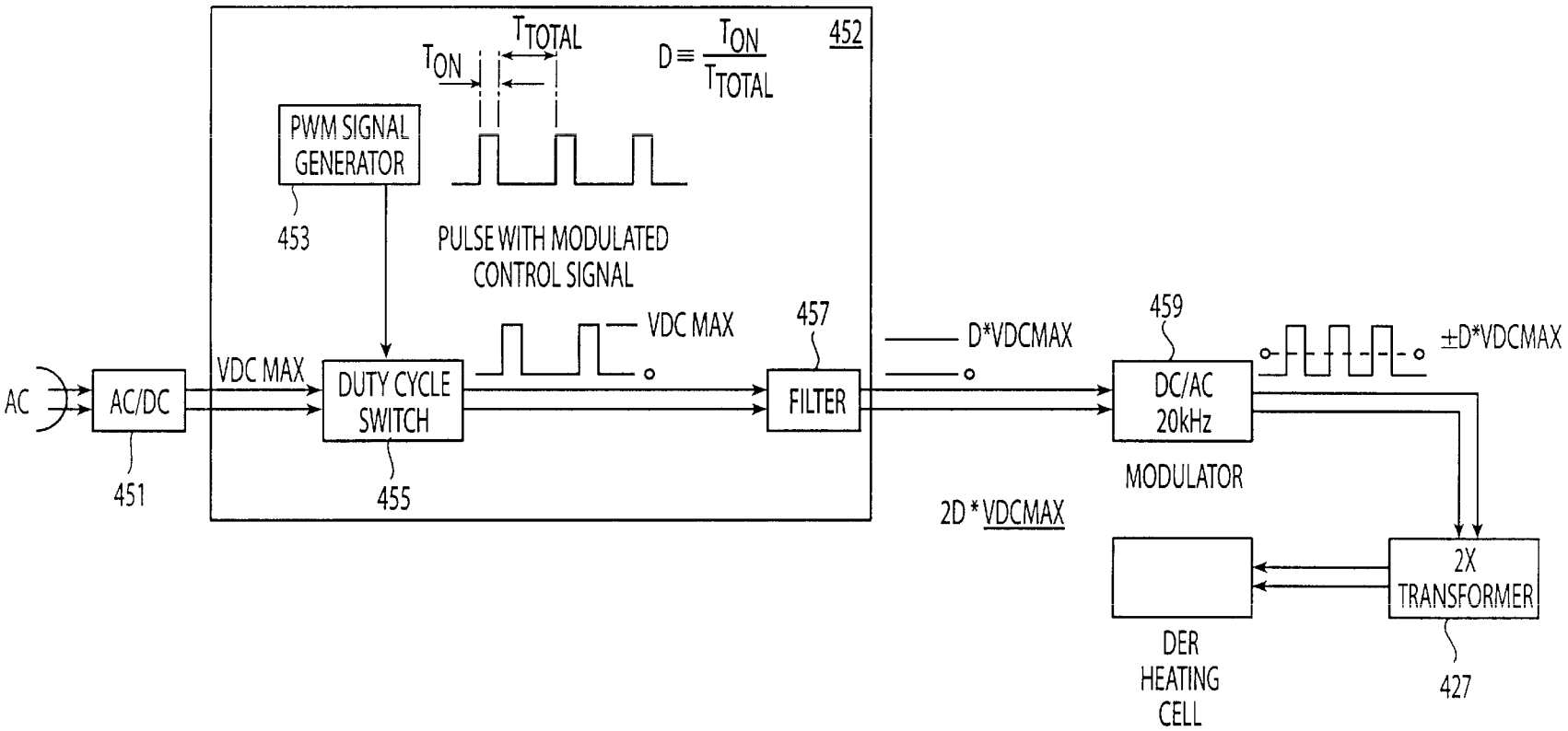
FIG. 18 is a block diagram of an electrical power supplier of the present invention.

In one preferred embodiment, the voltage level controller 452 includes a pulse width modulated signal generator 453, a duty cycle switch 455 and a filter 457, as depicted in FIG. 18. In this embodiment the pulse width modulated signal generator 453 produces a square wave having a duty cycle of D. The duty cycle switch 455 multiplies the square wave from the pulse width modulated signal generator 453 with the direct electrical current from the AC/DC converter 451. The output from the duty cycle switch 455 is another square wave with its voltage level substantially equal to the voltage level of the direct current, i.e., VDC max, from the AC/DC converter 451 and its duty cycle substantially equal to the duty cycle of the pulse width modulated signal. The output of the duty cycle switch 455 is then input to the filter 457 which in turn generates another DC electrical current with its voltage level at D*VDCmax. In this embodiment, the filter 457, e.g., an averaging filter, is configured to receive a square wave electrical current and generate a direct electrical current with is power substantially equal to the power of the received square wave electrical current. It should be noted that the voltage level of the output electrical current of the filter 457 is directly proportional to the value of D, i.e., the duty cycle of pulses with a modulation signal. In other words, as the duty cycle D increases the voltage level of the output of the filter 457 increases and vice versa. Therefore, the value of D controls the output voltage level of the filter 457. For instance, when the output voltage level of the AC/DC converter 451 is 150V and the duty cycle is 50%, then the output voltage level of the filter 457 would be 75V. Accordingly, as the duty cycle changes the output voltage level of the filter 457 would change proportionally.

The output of the filter 457 is then supplied to the DC/AC circuit 459 which produces another square wave with its frequency at 20 kHz (this can be as high as 200 kHz), and its peak voltage values are substantially equal to ±D*VDC max. The output of the DC/AC converter is then supplied to a 2× transformer 427. The electrical power supplied to the DER heating cell 13 from the transformer 427 is at a uniform frequency and a stable voltage. For instance, when the output voltage level of the filter 457 is 75V, the output of the DC/AC circuit 459 would be an alternating voltage with +75V and −75V as its peak values and the output peak voltage of the transformer 427 would be +150V and −150V.

Referring back to FIG. 17, the main controller 21 is coupled to a pump relay 429 to communicate with the liquid pump 15, coupled to a current measuring device configured to measure the electrical current flowing between the electrodes, and coupled to a temperature sensor interface 431 configured to communicate the temperature measured by the temperature sensor 19.

The main controller 21 is configured to regulate the operations of the liquid heating device 11 to produce the heated liquid at the desired temperature based on an operator entered selections, fixed and adjustable variables and feedback data. The operator entered selections include the desired temperature of the heated liquid. The fixed variables include the conductivity of the liquid, the gaps between the electrodes, the length of the electrodes.

The conductivity of liquid varies from one liquid source to another. Liquid from one source may contain impurities and particles causing the liquid to have high conductivity. The conductivity of the liquid is either assumed to be at a certain range or an operator selects an approximate value. In one preferred embodiment, the conductivity of the liquid is calculated. This calculation is achieved by the following steps: (1) applying a small but known electric voltage between the electrodes; (2) measuring the amount of the current flowing through the liquid; (3) calculating, using the Ohm's law, the resistance value of the liquid; and (4) calculating the conductivity of the liquid based on the resistance value since the conductivity is inversely proportional to the resistance.

The adjustable variables include the amount of electrical voltage applied to the electrodes and the amount of liquid supplied to the DER heating cell by the liquid pump. The feedback data include the temperature reading of the heated liquid measured by the temperature sensor.

The main controller is configured to receive all the relevant information which includes the operator entered selections, the fixed variables, and feedback data. Based on the received information, the main controller then regulates the adjustable variables. The main controller also includes sufficient memory and processing power to process the received information and to send appropriate signals for regulating the adjustable variables.

More specifically, in connection with the power supplier depicted in FIG. 18, the main controller 21 manipulates the duty cycle, i.e., D, of the pulse width modulated signal produced by the pulse width signal generator 453. As described above if more power is required to be supplied to the DER heating cell, the duty cycle of the pulse width signal is increased. Whereas, if less power is required to be supplied to the DER heating cell, the duty cycle of the pulse width signal is reduced. The controller is preferably implemented in a microcontroller. In alternative embodiments the controller can be implemented in electronic digital gates, microprocessors, Digital Signal Processing (DSP) chips, Application Specific Integrated Circuits (ASICs), or other electronic circuits available to one of ordinary skill in the art. For instance, the controller can be implemented in one microprocessor or a number of microprocessors each of which carries out different functions.

Figure 19:
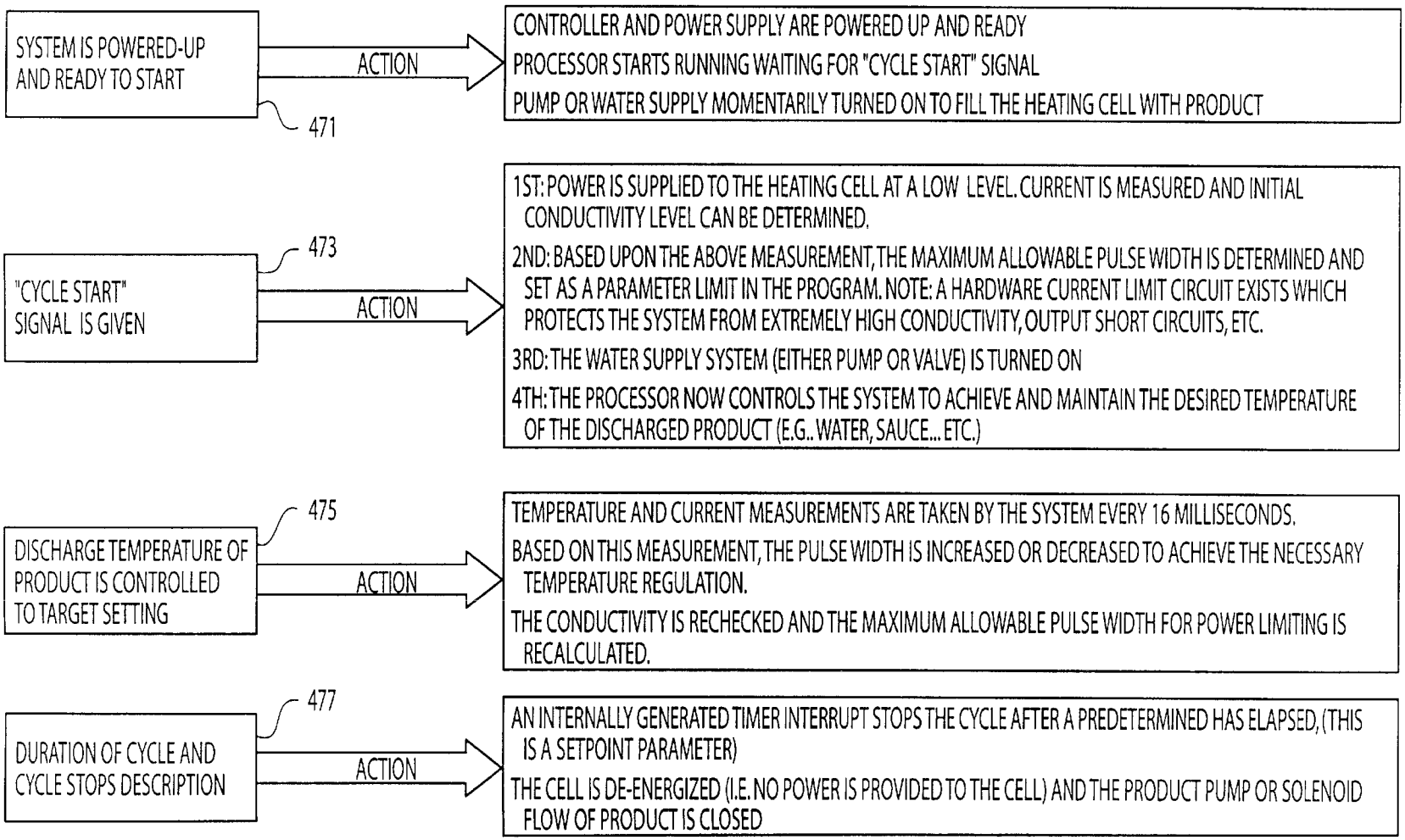
FIG. 19 is a flow chart of the steps in controlling various aspects of the liquid heating device.

In the preferred embodiment, a set of instructions, i.e., programs, is executed by the microcontroller. The instructions are preferably stored in a memory device and downloaded to the microcontroller during execution of the instructions. The set of instructions can be largely divided into four operational periods: power-up 471, cycle start 473, heated liquid production 475, and power-down 477 as illustrated in FIG. 19. These four periods are preferably cycled in a sequence for generating a set amount of heated liquid. In an alternative embodiment, the periods of cycle start and the heated liquid production can be performed multiple times continuously.

During the power-up period 471 the main controller and the power supplier are powered up and ready to begin the operation, the microcontroller begins its initialization operation and waits for a "cycle start" signal. Further, the liquid pump is momentarily turned on to fill the DER heating cell with the liquid to be heated. Further the following parameters are entered to the program during the power-up period: the desired temperature of discharged, i.e., heated, liquid, the desired length of time the DER heating cell is to be turned on for production of a preset amount of heated liquid, the maximum electric current limit, e.g., 20 Amps–30 Amps, beyond which the DER heating cell is not allowed to operate, and the AC voltage level from the wall outlet power source.

After completion of the above steps, the "cycle start" signal is generated which starts the cycle start period. During the cycle start period, the following steps take place:

(a) The electrical voltage from the power supplier is applied to the DER heating cell at a low level. The current flowing through the liquid to be heated is measured across a pair of electrodes and calculate the initial conductivity level of the liquid;

(b) Based upon the calculated conductivity level, a maximum voltage level to be applied to the heating cell is calculated by the microcontroller. For instance, in the power supplier embodiment depicted in FIG. 18, the microcontroller calculates the maximum allowable duty cycle for the pulse width modulated signal. If the measured current level reaches the maximum electrical current limit, the system is shut down;

(c) The liquid supply system, e.g., pump or valve, is turned on; and (d) The processor controls the system to achieve and maintain the desired temperature of the discharged liquid, e.g., water, sauce and etc.

During the heated liquid production period the following steps take place:

(a) Temperature of the heated liquid and electrical current flowing through the heated liquid are continuously monitored by the microcontroller every set interval, e.g., 8, 16, or 32 milliseconds or other optimal intervals. It should be noted that the electrical current flowing through the liquid can be measured at any gap when more than one gap is provided;

(b) Based on the measurements, the voltage level of the electrical current applied to the DER heating cell is increased or decreased depending upon whether more or less power is required to be supplied in order to produce the heated liquid at the desired temperature. For instance, in the power supplier embodiment depicted in FIG. 18, the pulse width is increased or decreased to achieve the necessary temperature regulation; and (c) The electrical conductivity of the heated liquid is rechecked and the maximum allowable pulse width for power limiting is recalculated by the microcontroller.

During the shut-down period the following steps take place:

(a) A timer interrupt signal, internally generated, (this is a set point parameter), initiates the shut-down after a predetermined time has elapsed or a predetermined amount of heated liquid has been produced measured by a flow meter; and (b) The cell is de-energized (i.e., no power is provided to the cell) and the product pump or solenoid permitting flow of product is closed.

In one preferred embodiment, the heating device 11 is utilized in food processing appliances such as hot beverage dispensers, hot food product dispensers, or sauce dispensers for both home and food service uses. The food service in this context includes coffee shops, restaurants and cafeterias in offices and schools.

Exemplary hot beverage dispensers, which utilize the heating device 11, include the following: coffee brewer and coffee dispensers which use soluble coffee or tea; tea brewers and dispensers; and other beverage dispensing appliances for supplying heated water to liquid concentrates, beverage dried powders or tablets, filter pouched coffee or teas for extraction, or beverage products where the package functions as the brewing and mixing chamber. Exemplary appliances for hot food product dispensers, utilizing the heating device 11, include any food processing appliances requiring the use of hot water in its preparation (e.g., dried soups, liquid food concentrates, dried food powders or tablets, and food products packaged for handling and delivering). Exemplary appliances for sauce dispensers, utilizing the heating device 11, includes sauce or cheese dispenser that requires heating of sauces or cheese that were kept cold.

The above exemplary appliances can be part of food service office beverage systems, food service vending machines, food service restaurant or banquet beverage systems, food service hot water supply systems, home water supply systems, and home beverage equipments (coffee makers and tea makers).

Figure 20:
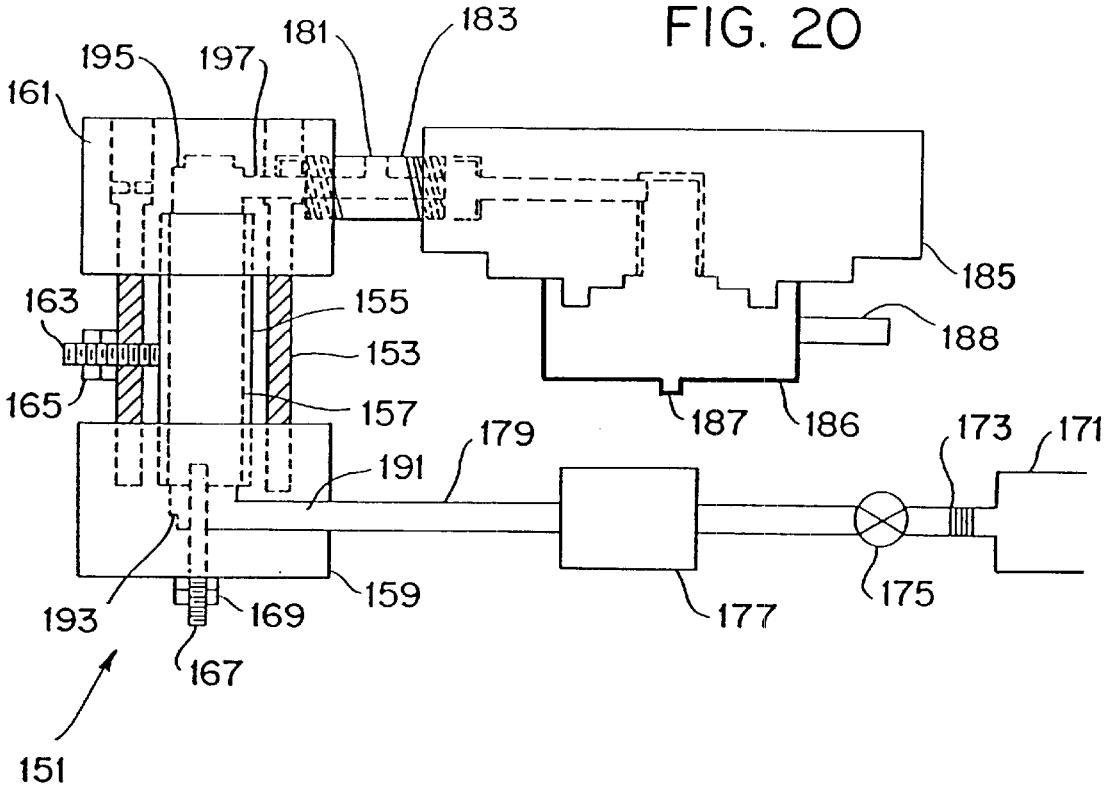
FIG. 20 is a system block diagram of a beverage dispenser.

One preferred embodiment of a beverage dispenser 151 of the present invention, including a DER heating cell having a rod shaped inner electrode 157 and a cylindrical outer electrode 155, is illustrated in FIG. 20. In alternative embodiments, the DER heating cell is any of the DER heating cell embodiments described above. The DER heating cell is surrounded by an insulating tube 153. The electrodes 155, 157 and insulating tube 153 are firmly fixed and fluid sealed by an inlet sealant 159 and an outlet sealant 161. The inlet sealant 159 receives water from an inlet pipe 179 connected to a water supply regulator 177 and a water source connector 173. The water source connector 173 is connected to a water supply source 171. The outlet sealant 161 is in fluid communication with a dispensing head 185. A transition tube 183 is optionally provided between the outlet sealant 161 and the dispensing head 185.

The water supply source 171 is, preferably, a municipal water pipe. However, any other source such as bottled water or well water is adequate for the present invention. The connector 173, adapted to receive water from the water supply source, is, preferably, a water pipe connector. In an alternative embodiment, the connector 173 includes a sediment or treatment cartridge to filter particles and/or for treating the water. The treatment may, for example, be mineralization of the water to increase conductivity.

A conventional valve 175, configured to turn on or to shut off the water supplied to the pump, is optionally provided. The water supply regulator 177 is either a pump or a pressure regulator to deliver water to the heating unit. The pump is capable of delivering a water pressure up to 20 bar, and is, preferably, a CP3 or CP4 manufactured by Eaton Products. The pressure regulator is a conventional pressure regulator to adjust the water pressure in the pipe.

The water entering through the inlet sealant 159 passes through a heating passage or heating passages, formed by a gap or gaps, between the electrodes. As the water passes through the heating passage(s), the water generates heat as described above. The heated water, then, exits the heating passage through the outlet sealant 161 to the transition tube 181. The heated water is, then, flows to the dispensing head 185.

The inlet and outlet sealants 159, 161, the transition tube 183, the dispensing head 185 and the insulating tube 153 are molded from a rigid, dielectric material which is also thermally non-conductive, graded for food processing and capable of withstanding high water pressure, e.g., 20 bars. Therefore, insubstantial electric current is leaked through the sealants and the transition tube, and the water temperature is preserved. For instance, the material can be similar to the material described in connection with top and bottom caps of FIGS. 10–14.

Each of the inlet and outlet sealants 159, 161 has an opening to receive or release water 191, 197, respectively, and a plurality of concentric annular steps 193, 195 with which to receive portions of the inner and outer electrodes. In an alternative embodiment, any sealant having an opening to receive or release water and providing electrical and fluid seal among the inner and outer electrodes 155, 157 and the insulating tube 153 is adequate for the present invention.

The insulating tube has an opening to receive an electrical connection 163 to the outer electrode 155. The inlet sealant 159 has another opening to receive an electrical connection 167 to the inner electrode 157. In alternative embodiments, the electrical connections to the electrodes are provided through the inlet or the outlet sealants.

In one preferred embodiment, the heating unit is thermally and electrically insulated by the insulating tube and the inlet and outlet sealants. The thermal insulation increases the overall energy efficiency of the heating unit by keeping the thermal energy from escaping to its environment.

It should be noted that if the concentric or plate shaped electrodes are utilized, then the concentric corresponding top and bottom caps or top and bottom pieces should be used as well as described above.

Referring back to FIG. 20, the heated water flows to the dispensing head. In one embodiment, a beverage brewing chamber 186, arranged to form a fluid seal with the dispensing head to withstand up to 15–20 bars of pressure and attached to a handle 188, is provided. A predetermined amount of beverage making substance packaged in a capsule or placed on a filter is provided inside the beverage brewing chamber before the brewing chamber forms the fluid seal with the dispensing head. (In one embodiment the capsules are provide with a pin to punch a hole to the capsules. The pin can be disposed on the dispensing head.) The heated water dispensed from the dispensing head and the beverage making substance are mixed under pressure and, then, the brewed product is dispensed from the bottom of the brewing chamber to a cup.

In one preferred embodiment, the beverage substance, to be extracted under pressure, is sealed in a cartridge (or a capsule) which is provided into a cartridge holder, which is similar to the brewing chamber. The heated water from the dispensing head and air are injected under pressure between 1 to 20 bars and, more preferably, 5–15 bars into the cartridge which includes an extraction face. This pressure is exerted to the extraction face of the cartridge against a relief surface, which includes relief and recessed elements, of the cartridge holder. After a sufficient injection of the heated water and the air into the cartridge, the extraction face is torn apart at the locations of the relief elements or recesses. Subsequently, the beverage product, brewed under pressure in the cartridge, is released from the cartridge and dispensed to a cup located there below. This embodiment allows the beverage product to be extracted under pressure between 1 to 20 bars and, more preferably, 5–15 bars.

In another embodiment, a conventional coffee filter holding the beverage making substance is attached to the dispensing head. In yet another embodiment, the dispensing head dispenses the heated water directly into a cup, which has beverage making substance placed therein, located below the dispensing head.

The beverage making substance includes grounded coffee beans, grounded tea leaves, liquid beverage concentrates, other similar grounded, powdered or tablet beverage products.

The dispensing head may include a ground electrode, not shown in FIG. 20, disposed such that it touches the heated water supplied from the heating unit. This feature electrically grounds any leakage current flowing from the electrodes through the heated water to the dispensing head. In an alternative embodiment, the water supplied from the heating unit may be physically separated by addition of a container which receives the water in a chamber which opens and closes to allow pockets of water to drop into a second chamber which opens and closes to allow electrically neutral water to be dispensed. In another alternative embodiment, in order to dispense electrically neutral water, an in-line rotary star type valve or any other device can be used as long as it separates the hot water from the DER heating cell, which may carry some electricity, from the hot water being used for reconstitution or being dispensed or to insure the finished beverage being dispensed is electrically neutral. In yet another alternative embodiment, electrically neutral heated water is obtained by allowing water from the heater to fill an intermediate container holding a desired amount of water for dispensing at which point, once filled, the power of heating unit is shut off and the heated water is dispensed.

Figure 21:
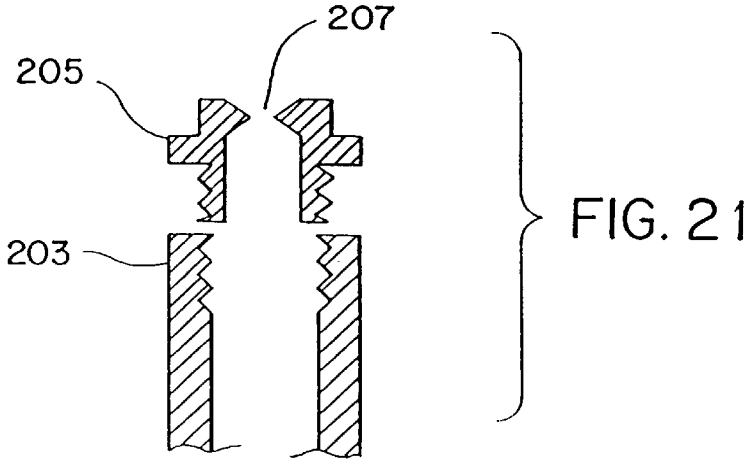
FIG. 21 is a side cross-sectional view of the heating unit with a cap having a conical annular opening.

FIG. 21 illustrates another preferred embodiment of an outlet sealant which includes a threaded cap 205 having a conical annular outlet 207. The conical annular outlet 207 forces the water flowing through it to speed up and pick up particles and impurities which otherwise may clog up the outlet.

In one alternative embodiment, steam is produced by combining the DER heating cell 13 with a hot water bypass line coupled to the outlet side 119 of the heating passage 107 in the embodiment depicted in FIGS. 2–4. The hot water bypass line, which includes a reduced size orifice to increase the water pressure passing therein, in combination with sufficiently high water temperature, produces the steam. In one exemplary embodiment, as in steam wands in espresso machines, the hot water bypass line is provided near or at its point of use. In another embodiment, the hot water bypass line is provided near the DER heating cell 13, even though this configuration precipitates minerals which may cause the hot water bypass line to be clogged after many repeated uses. It should be noted that the hot water bypass line can also be coupled to the concentric or plate shaped electrode heating cell embodiments described above.

Referring back to FIG. 20, the transition tube 183 optionally includes an opening 181 to receive a temperature sensor. In an alternative embodiment, the temperature sensor is located in the DER heating cell. Regardless where the temperature sensor is located, it senses the temperature of the heated water.

A beverage dispenser controller is used to regulate the operations of the beverage dispenser to produce the heated water at the desired temperature based on information similar to that provided to the main controller 21 in connection with FIGS. 17–18, i.e., operator entered selections, fixed and adjustable variables and feedback data. The beverage dispenser controller also includes sufficient memory and processing power to process the information and to send appropriate signals for regulating the adjustable variables.

One preferred embodiment of the beverage dispenser controller implemented with a microcontroller is illustrated in FIG. 22. The microcontroller 253, preferably, is a MIC 2000 controller manufactured by Partlow. The MIC 2000 controller is a microcontroller based single loop process controller. It controls a variety of processes including those requiring dual 4–20 mA output with full PID (Proportional, Integral and Derivative controls). In alternative embodiments, the beverage dispenser controller is a microcontroller, an ASIC chip, a computer, electronic logic chips, PID controllers or any combination of them.

The beverage dispenser controller also includes connections to an electrical power supplier 251, which includes an optional power transformer 261 and an electric power rectifier 257 controlled by 4–20 mA control signal from the MIC 2000 controller. The electric power rectifier 257 is, preferably, a silicon control relay (SCR) rectifier. The controller also includes connections to an adjustable time delay relay 259 and receives feedback data from a thermocouple 275 which is connected to the temperature sensor. The power supplier may include a ground fault interrupter 263 which acts as a fuse.

The time delay relay 259 is utilized when the dispenser is to be operated after a long pause. After each used of the dispenser, the heating unit retains water in its heating passage. If the dispenser is not continuously used, then it causes the retained water to cool down, thereby necessitating a cold start period. In this cold start period, actuating the water supply regulator is delayed so that sufficient time is provided to raise the temperature of the water retained in the heating passage.

A heated liquid food product dispenser, with similar structures as that of the beverage dispenser discussed above, reconstitutes food products, such as dried soups, liquid food concentrates, dried food powders and the like, with heated water. The liquid food dispenser includes a mixing chamber instead of the brewing chamber of the beverage dispenser described above.

One preferred embodiment of the heated liquid food product dispenser, a portion of which is illustrated in FIG. 23, includes a heating unit 483, a hopper 485, an auger screw 487, and a mixing chamber 489. The heating unit 483 is any one of the liquid heating device embodiments discussed above.

The heating unit 483 is any one of the DER heating unit discussed above to heat water to a predetermined temperature, which is, preferably, up to 200° F. In another embodiment, the predetermined temperature is up to 300° F. More specifically, the embodiment for reconstituting dried food, the temperature of the heated water can be between 170–185° F., and the embodiment for beverage extraction can be between 185–195° F.

The hopper 485 is configured to hold dried food products. The auger screw 487 is connected to the hopper 485 and configured to dispense a certain amount of the dried food to the mixing chamber. The amount of disposed dried food is proportional to the length of time the auger screw 487 is activated. In an exemplary embodiment, when the auger screw 487 is activated for 3 seconds, it dispenses 2 grams of the dried food product.

The mixing chamber 489, preferably, fluidly sealed with the heating unit, receives heated water from the heating unit 483 and the dried food products from the auger screw 487, mixes the water and dried food product, and dispenses the reconstituted food products.

In one preferred embodiment, the mixing chamber 489 is static. In other words, the mixing is achieved by the heated water, which is supplied at a high pressure to the mixing chamber in this embodiment, causes the water and the dried food to swirl around, thereby mixing the water and the dried food. In another preferred embodiment, the mixing chamber includes an agitator which includes a motor 491 driving an impeller 493 in order create a swirl in the mixing chamber.

Figure 24:
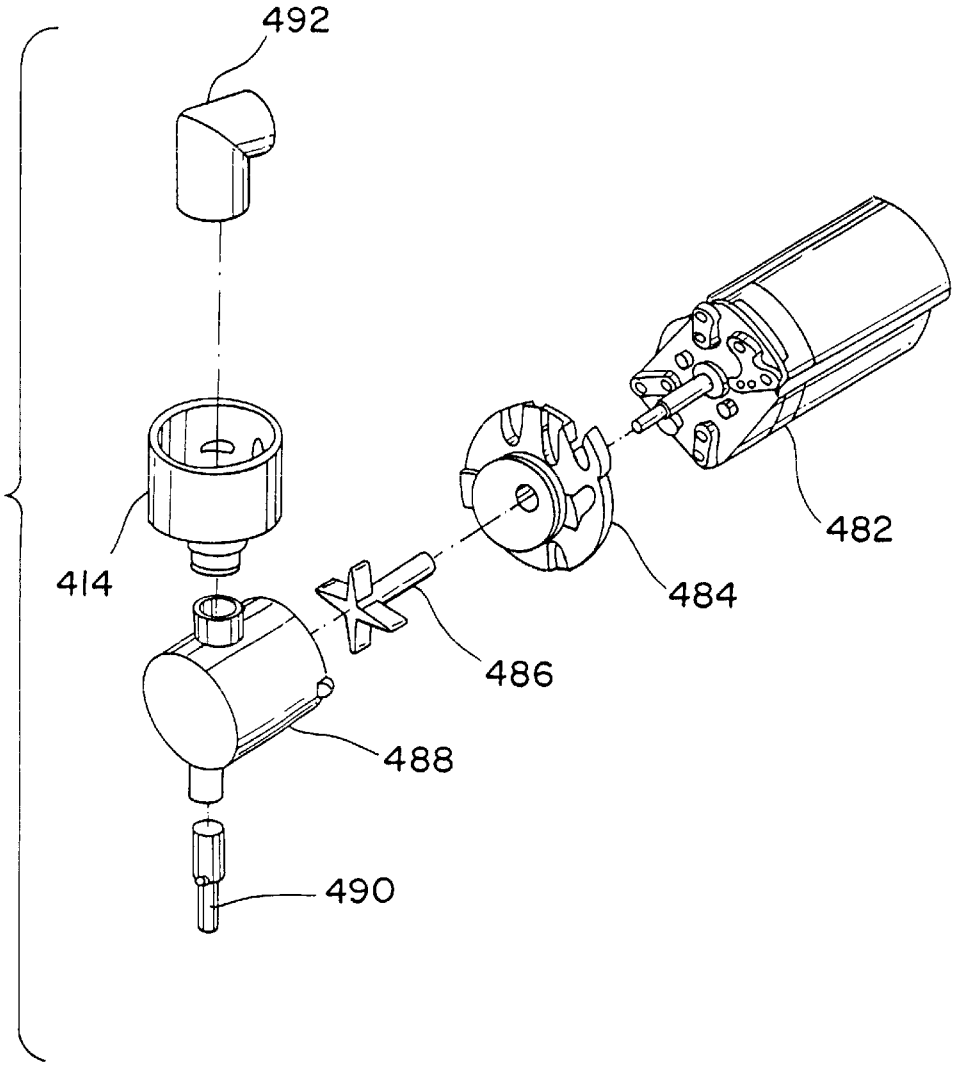
FIG. 24 is an alternative embodiment of a portion of the reconstituted beverage or food product dispenser.

Referring to FIG. 24, an alternative embodiment of the above described mixing chamber includes a motor 482, an impeller 486 and an interface 484 therebetween. The impeller 486 is placed inside a mixing chamber 488. The mixing chamber 488 is configured to receive dried food from a funnel 494. The funnel, in turn, is configured to receive dried food from a tube 494 connected to the hopper 485. The mixing chamber 488 is also configured to receive heated water from the DER heating unit 483. The received heated water and the dried food are mixed in the mixing chamber 488 and discharged through a nozzle 490.

In an alternative embodiment of the heated liquid food product dispenser described above, instead of the dried food product, concentrated food products are provided. In this alternative embodiment, the hopper and the auger screw are replaced by a concentrate food product dispenser that dispenses a predetermined amount for the concentrate food product into the mixing chamber.

In an alternative embodiment of the beverage dispensers and the heated liquid food product dispenser discussed above, the beverage making substance or the food products may be supplied to the DER heating passage along with unheated water. In this embodiment, the DER heating device heats the water and the beverage making substance or the food products simultaneously. In addition, a filter is, optionally, provided at the dispensing head.

Although the preferred embodiments of the invention have been described in the foregoing description, it will be understood that the present invention is not limited to a water heating mechanism in a coffee brewer. For instance, the DER can be utilized in any application where heating other types of liquid is required. It should be understood that the materials used and the mechanical detail maybe slightly different or modified from the description herein without departing from the methods and composition disclosed and taught by the present invention as recited in the claims.

What is claimed is:

1. A liquid heater comprising:

first, second, and third electrodes each having an electrically conducting surface;

a heating passage defined, at least in part, by the electrically conducting surfaces a first opening configured to receive liquid into the heating passage, the heating passage comprising:

a first passage portion extending between the first and second electrodes for directing liquid flowing therethrough in a longitudinal direction in electrical contact with the electrically conducting surfaces for generating heat in the liquid, wherein the second electrode is laterally disposed between the first and third electrodes with respect to the longitudinal direction, and a second passage portion disposed in fluid communication in series with the first passage portion and extending between the second and third electrodes for electrically contacting any liquid flowing therethrough with the electrically conducting surfaces, a liquid inlet disposed upstream of the first and second passage portions and configured for receiving a liquid into the passage, a liquid outlet disposed downstream of the first and second passage portions and configured for outletting the liquid from the passage; and an electrical power supplier configured to supply an electrical voltage across pairs of the electrically conducting surfaces that are disposed to electrically contact the liquid in the passage portions such that an electric current flows between the electrically conducting surfaces of each pair and through the liquid in the first and second passage portions such that the liquid therein generates heat.

2. The liquid heater of claim 1, which further comprises a dispensing head coupled to the heating passage and configured to receive and dispense the heated liquid from the heating passage.

3. The liquid heater of claim 2, which further comprises a chamber arranged to form a fluid seal with the dispensing head and to received the heated liquid from the dispensing head and wherein the first and second electrodes are made of graphite.

4. The liquid heater of claim 3, wherein the chamber is a brewing chamber arranged to hold beverage making substance to be mixed with the heated liquid.

5. The liquid heater of claim 1, which further comprises a second controller configured to regulate electrical power supplied to the first and the second electrodes such that the liquid is heated to a predetermined temperature.

6. The liquid heater of claim 5, which further comprises:

a liquid supply regulator configured to supply the liquid to the heating passage; and the second controller is configured to regulate the liquid supply regulator such that a predetermined amount of liquid is supplied to the heating passage.

7. The liquid heater of claim 5, which further comprises:

a temperature sensor configured to measure the temperature of the heated liquid; and the second controller is configured to regulate the amount of electrical power supplied to the heating passage based on the measured temperature.

8. The liquid heater of claim 5, further comprising a delay device configured to delay actuating the liquid supply regulator in a cold start stage in which previously supplied unheated liquid is present in the heating passage.

9. The liquid heater of claim 1, wherein the first electrode comprises a rod shape disposed within the second electrode having a cylindrical shape.

10. The liquid heater of claim 9, further comprising:

the first second and third electrodes have substantially cylindrical shapes, the first electrode surrounding the second electrode, and the second electrode surrounding the third electrode.

11. The liquid heater of claim 1, wherein the electrical power supply is configured to supply electrical voltages to the electrodes in an alternating polarization configuration to adjacent electrodes.

12. The liquid heater of claim 11 further comprising a third controller configured to adjust, turn off or turn on the electrical voltage applied to each of the electrodes.

13. The liquid heater of claim 1, wherein the first electrode has a conical shape and the first electrode is disposed within the second electrode.

14. The liquid heater of claim 1, further comprising an electrode shifter configured to move one of the electrodes in order to adjust the distance therebetween.

15. The liquid heater of claim 1, wherein the electrically conducting surfaces of the first, second, and third electrodes are substantially planar.

16. The liquid heater of claim 15, wherein the electrical power supply is further configured to supply electrical voltages to the electrodes in an alternating polarization configuration, and further comprising a fourth controller configured to adjust, turn on or turn off the electrical voltage applied to each of the electrodes.

17. The liquid heater of claim 1, wherein at least one of the electrically conducting surfaces of the first and second electrodes includes a pattern comprising a plurality of arcuate grooves thereon.

18. The liquid heater of claim 1, which further comprises:

a first sealant having an opening to receive the liquid; and a second sealant having an outlet, wherein the heating passage is fluid sealed by the first and second sealants, wherein the outlet is defined by a conical annular opening.

19. The liquid heater of claim 1, which further comprises a transition tube coupled to the heating passage and the dispensing head, the transition tube configured to transfer the heated liquid from the heating passage to the dispensing head.

20. The liquid heater of claim 1, which further comprises a hot liquid bypass line, configured to generate steam, being coupled to the heating passage, wherein the liquid is water.

* * * * *